US005375984A

United States Patent [19]

Wehling

[11] Patent Number: 5,375,984

[45] Date of Patent: Dec. 27, 1994

[54] PERISTALITIC PUMP

[75] Inventor: Werner Wehling, Dorsten, Germany

[73] Assignee: Allweiler AG, Radolfzell, Germany

[21] Appl. No.: 60,732

[22] Filed: May 10, 1993

[30] Foreign Application Priority Data

May 11, 1992 [DE] Germany ..... 4214917

[51] Int. Cl.[5] ..... F04B 43/08

[52] U.S. Cl. ..... 417/477.1; 417/477.3

[58] Field of Search ..... 417/474–477, 417/477 R, 477 B, 477 H

[56] References Cited

U.S. PATENT DOCUMENTS

| | | | |
|---|---|---|---|
| 3,180,272 | 4/1965 | Broadfoot | 417/475 |
| 3,402,673 | 9/1968 | Ballentine et al. | 417/475 |
| 4,214,855 | 7/1980 | Gerritsen | 417/477 |
| 4,540,350 | 9/1985 | Streicher | 417/475 |
| 5,249,938 | 10/1993 | Hall | 417/476 |

FOREIGN PATENT DOCUMENTS

| | | | |
|---|---|---|---|
| 188219 | 2/1956 | Germany | 417/476 |
| 9203042 | 4/1992 | Germany . | |
| 583008 | 12/1946 | United Kingdom | 417/476 |
| 713239 | 8/1954 | United Kingdom . | |
| 8805868 | 2/1988 | WIPO . | |

*Primary Examiner*—Richard A. Bertsch
*Assistant Examiner*—Peter Korytnyk
*Attorney, Agent, or Firm*—Bachman & LaPointe

[57] ABSTRACT

In a peristaltic pump comprising a pump tube with elastically deformable wall, which pump tube is arranged in a pump housing at the bottom thereof and is fitted into the pump housing with a portion which is curved in a part-circular configuration around a shaft of a rotor within the wall of the peristaltic pump and at a radial spacing relative thereto, the cross-section of the pump tube being partially varied during the conveying operation by at least one member of the rotor which presses the pump tube in respect of cross-section against a support means, with a reduction in the internal volume, the rotor is formed dish-like from a rotor end portion and a rotor wall and the latter is directed towards the bottom of the pump housing, the shaft of the rotor being fitted directly to the end portion thereof.

16 Claims, 2 Drawing Sheets

PERISTALITIC PUMP

BACKGROUND OF THE INVENTION

The invention relates to a peristaltic pump comprising a pump tube with elastically deformable wall, which pump tube is arranged in a pump housing at the bottom thereof and is fitted into the pump housing, substantially in a U,shape in plan view between two connection ends - with a portion which is curved in a part-circular configuration around a shaft of a rotor within the wall of the peristaltic pump and at a redial spacing thereto, the cross-section of the pump tube being partially varied during the conveying operation by at least one member of the rotor, which presses the pump tube in respect of cross-section against a support means, with a reduction in the internal vole.

A peristaltic pump of that kind is described in British patent specification No 628 785, having a pump tube and pressure rollers which produce in the interior of the tube a chamber portion which is closed off by two squeeze locations. When the rotor rotates the pressure rollers, as squeezing members, roll against the stationary pump tube which bears against the wall of the housing, and the squeeze locations are displaced with the pressure rollers in the conveying direction, whereby the material to be conveyed, which is in the interior of the tube, is conveyed from the tube intake to the discharge end of the pump tube. The squeeze location which is adjacent the pump intake, by virtue of the return force of the tube wall, produces a suction force on material to be conveyed which is disposed in an upstream-position supply container and which is thus drawn in and then transported by the above-described chamber portion to the discharge end of the pump tube.

In order to be able to influence the contact pressure characteristics as between the pump tube and the pressure roller, the roller spindles are displaceable on a support structure, with the result that inaccurate settings occur in particular when untrained personnel work on the tube pump.

In the state of the art irregular pressures on the pump tube are inevitable, and as a result adverse influences on the service life of the pump tube due to non-parallel deformation of the pump housing and the rotor, caused by one-sided transmission of force from the wall of the pump housing into the bottom of the housing and central transmission of force from the rotor rim by way of spokes to the rotor hub.

In quite general terms, in known peristaltic pumps, a large detrimental space, a space filled with lubricant-/coolant or in the event of rupture of the tube with fluid being conveyed of uniform depth over the entire pump housing cross-section is found to be disadvantageous. Lubrication and cooling of the squeezing member of the slide shoe and the pump tube by dipping and spraying could not provide any remedy in that respect.

Those deficiencies are of significance not least also for the reason that on the one hand, in particular when dealing with dirty or corrosive agents to be conveyed, bursting or rupture of the pump tube can result in extremely undesirable contamination of the area around the pump while on the other hand replacing the pump tube is particularly expensive.

SUMMARY OF THE INVENTION

In consideration of that state of the art the inventor set himself the aim of providing a peristaltic pump of the kind described above, with which the deficiencies encountered are overcome.

By virtue of the teaching of the present invention, a uniform pressure on and an increase in the service life of the pump tube is achieved, combined together with a reduction in the detrimental space with at the same time optimization of lubrication and cooling of the squeezing member and the pump tube.

In accordance with the invention the rotor is formed dish-like from a rotor bottom or end portion and a rotor wall and the latter is directed towards the bottom of the pump housing, wherein the shaft of the rotor is fitted directly to the rotor end portion. In addition, in accordance with a further feature of the invention, the rotor end portion and the drive shaft of the rotor are to be integrally formed, that is to say they are in the form of a one-piece structure.

It has been found desirable that the dish-like pump housing in cross-section has a bottom portion which is formed on the wall approximately at a right angle and a bottom portion which is inclined from the first-mentioned bottom portion towards the rotor at an angle of inclination, wherein said bottom portions, with the pump wall, define a channel space in the pump housing, into which the rotor wall engages.

In that way therefore the rotor rim portion is formed at one side on the rotor end portion and the rotor end portion is arranged opposite the pump housing bottom.

The forces produced by the hydraulic effect or by the tube pressure during the conveying operation deform the pump housing and the rotor in opposite relationship, thereby providing for a greater degree of parallelism of the pressing surfaces and thus a more uniform pressure with at the same time an increase in the service life of the pump tube.

Due to the shaft/hub connect ion which is eliminated in accordance with the invention but which is present in the state of the art, the housing bottom can be taken directly to the rotor end portion and thus the detrimental space can be considerably reduced.

In the peristaltic pump according to the invention a slide shoe, preferably a pair thereof, projects from the rotor wall as the pump tube-squeezing member, with a radially outwardly directed slide surface, towards the pump tube. In that arrangement the extent by which the slide shoe projects preferably decreases from a maximum towards both sides of the slide surface; the diameter of the rotor through the maximum serves in that respect as a straight line of symmetry.

In an advantageous configuration of the slide shoe the outside contour thereof approximately corresponds in plan view to that of half an oval which is cut on its long axis.

In accordance with a further feature of the invention the slide shoe is provided between the slide surface and the rotor with through openings for lubricant or coolant, while preferably the slide surface can be formed along a wall of the slide shoe and the wall can define the through openings in the slide shoe.

In accordance with the invention the rotor end portion is also provided with at least one through opening for the lubricant or coolant, while at least one of the through openings in the rotor end portion can be adjacent to the slide shoe.

In accordance with the invention associated with the through opening is at least one conveyor vane which projects from the rotor end portion and which for example can extend from the maximum of the slide shoe on both sides along the side edge of the opening in the rotor end portion.

The last-mentioned features serve to optimize lubrication and cooling of the slide shoe and the pump tube; the lubricant/coolant level is increased to such a degree that an increased lubricant/coolant flow and uniform temperature distribution over the pump housing become possible due to the conveyor vanes which are disposed on the pump cover side of the rotor and due to the through openings in the slide shoe and the return-flow openings in the rotor end portion.

BRIEF DESCRIPTION OF THE DRAWINGS

Further advantages, features and details of the invention will be apparent from the following description of a preferred embodiment and with reference to the drawing in which.

DETAILED DESCRIPTION OF PREFERRED EMBODIMENTS

Figure 1:
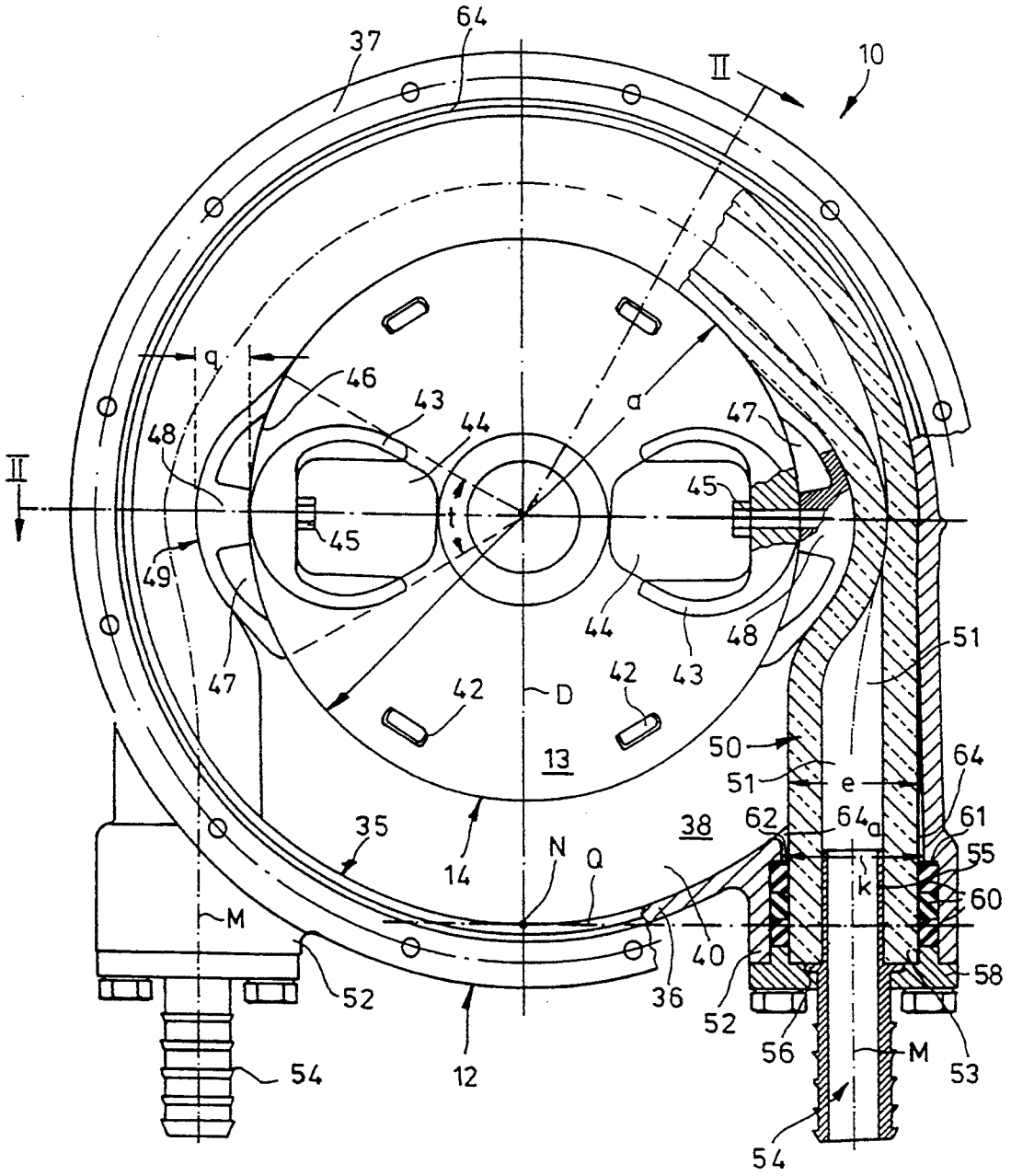
FIG. 1 is a plan view of a pump partly in section.

A peristaltic pump 10 has a dish-like pump housing 12 of an inside diameter d of about 320 mm and a height h of about 75 mm, and, in the pump housing 12, a rotor 14 which is rotatable on a pump shaft 16 about the axial line A thereof.

The pump shaft 16 is mounted in the region of a central bearing neck 18, of a mean outside diameter b of about 95 mm, of the pump housing 12 which comprises rigid material and which is preferably cast from metal. The pump shaft 16 is mounted by means of an axial thrust bearing 20 and a radial bearing 22, between which a spacer bush 24 embraces the pump shaft 16. The spacer bush 24 is surrounded by a securing ring 26 for the thrust bearing 20 and a securing ring 27 for the radial bearing 22. Reference 28 identifies a space for bearing grease between the securing rings 26, 27, while reference 30 identifies a spacer ring for the thrust bearing 20 within an intermediate ring **26*a*, adjacent which is an outer splash ring 32. On the rotor side, a sealing element 34 adjoins the radial bearing 22 at an outer support ring 27a towards the rotor 14**.

Figure 2:
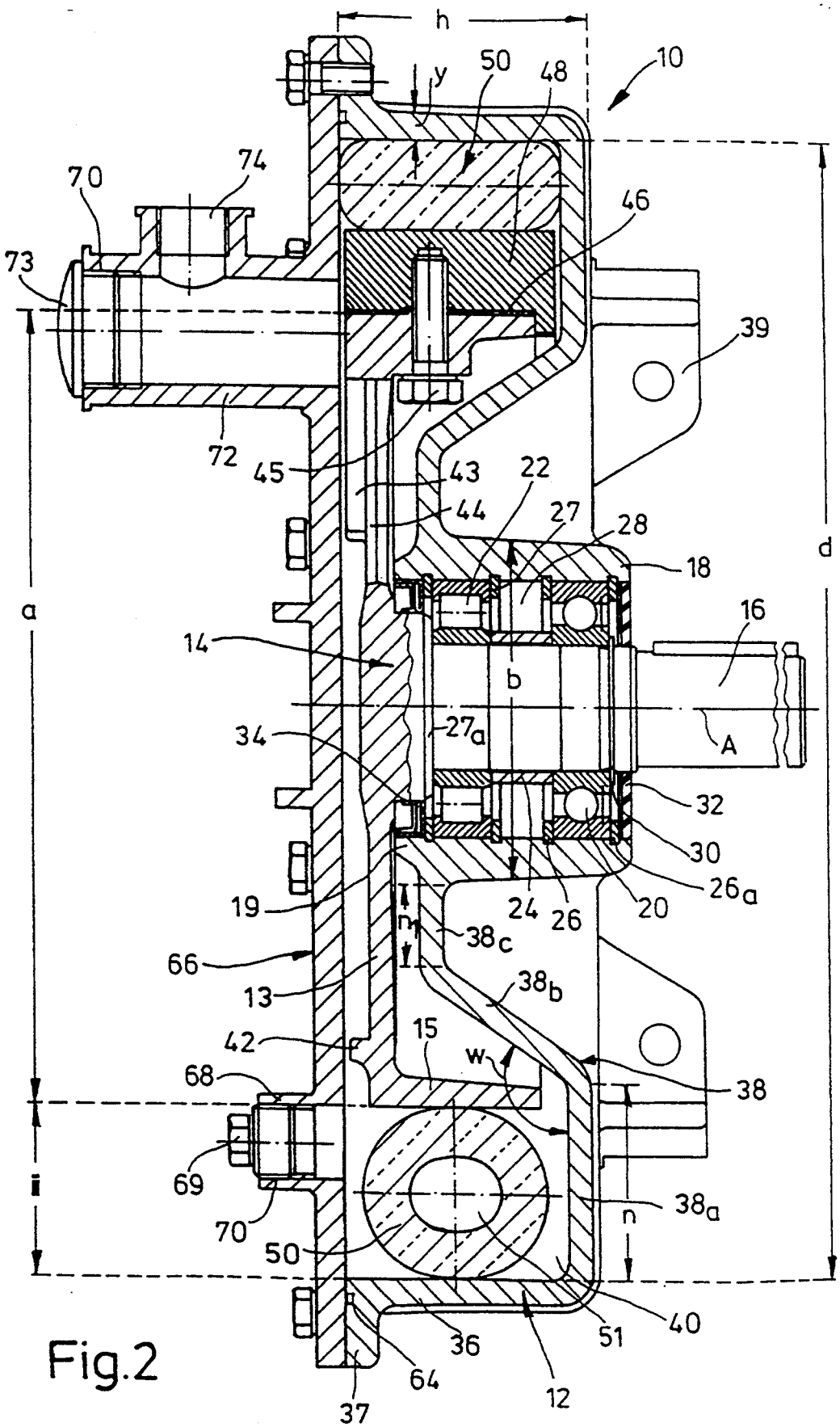
FIG. 2 is a view in section through FIG. 1 taken along line II—II therein.

As shown in FIG. 2, the bottom 38 which is formed on the wall 36 of the pump housing 12 is composed in terms of cross-section of a bottom first portion **38*a* which is approximately at a right angle to the wall 36 and which has a cross-section length n of rather more than 55 mm, an inclined bottom second portion 38*b* which extends from the bottom portion 38*a* at an inclined angle w of about 120°, and an annular bottom third portion 38*c* of a cross-section length nl of about 25 mm which extends parallel to the bottom first portion 38*a* from the inclined bottom second portion 38*b* to the bearing neck 18 and which is formed on same. The bearing neck 18 projects slightly with an annular rib 19 that accommodates the above-mentioned WDR-element 34, axially beyond the annular bottom third portion 38*c* towards the rotor 14**.

The wall 36 and the adjoining bottom first portion **38*a* of the pump housing 12, with the inclined bottom second portion 38*b*, define a substantially annular channel space 40. Connection plates 39 for pump mounting purposes are cast on the outside of the bottom 38**.

The rotor 14 which is formed on the pump shaft 16 is designed, also in a dish-like configuration, with a rotor wall 15 which extends from a rotor end portion 13 and which engages in the channel space 40, which is filled with lubricant or coolant - while shaped knobs 42 and conveyor vanes 43 which are horseshoe-like in plan view project from the outer surface of the rotor 14. The conveyor vanes 43 surround openings 44 for lubricant or coolant in the rotor end portion 13, as can be seen in particular from FIG. 1. The outside diameter a of the rotor 14 measures about 220 mm so that the mean radial spacing i of the rotor wall 15 in the channel space 40 from the housing wall 36 works out at nearly 50 mm.

The rotor wall portion 15 has two screws 45 passing there through for fixing a respective adjustment plate 46 and slide shoe 48 which, as shown in FIG. 1, provides a curved slide surface 49 with a maximum spacing q of rather more than 20 mm from the rotor wall portion 15 and a length which is determined by an angle t of about 65°. The contour of the slide surface 49 in plan view approximately corresponds to that of half an oval, cut along the longer axis of the oval.

While the rotor 14 is rotated, the slide shoe 48 which is provided with through openings 47 of approximately triangular configuration in plan view partially compresses a pump tube 50 of an outside diameter e of about 52 mm, which is arranged in the channel 40 between the wall 36 of the pump housing 12 and the rotor wall portion 15, in such a way that the volume of the tube interior 51 temporarily goes towards zero and thus there is formed within the pump tube 50 a conveyor chamber for the medium to be conveyed, for example ink or dye, industrial lye or solution, or the like; the medium to be conveyed is entrained by the described squeeze location during the rotary movement of the rotor 14.

The pump tube 50 of flexibly deformable material extends - as stated: in the channel space 40, in a U,shape between two mutually parallel wall connections 52 of the pump busing 12 and its tube ends 53 are each connected within the wall connections 52 to a respective enclosed pump connection 54. The latter is provided with an external radial rib 56 which bears on the inside against a gland cover 58 which is screwed to the wall connection 52, and projects into the interior 51 of the tube with an insertion portion 55 which terminates near the pump wall 36.

The gland cover 58 holds sealing rubber-elastic packing rings 60 and a gland base ring 61 which bears against a shoulder-like gland bottom or base 62. The spacing thereof from the inside surface 35 of the wall 36 approximately corresponds to the thickness y of the wall of about 8 mm.

The one pump connection 54 forms the intake connection of the peristaltic pump 10, into which the medium to be conveyed is drawn by virtue of a suction force generated by the return force of the pump tube 50. The other pump connection 54 serves as a discharge for the medium conveyed.

The pump tube 50 is clamped directly at the wall 36 of the pump housing 12 at the inside diameter d, the shoulder-like gland base 62 arranged between said inside diameter d and a tangent Q to the inside surface 35 of the wall 36 through the intersection N thereof with the pump diameter D which is parallel to the centre lines of the wall connections 52.

The pump tube 50 is clamped by means of an elastomer gland 60 within the pump housing 12, which reduces the specific clamping forces on the pump tube 50 and in addition ensures sealing integrity thereof relative to the pump housing 12. FIG. 1 shows a gap 64 which tapers from the above-mentioned gland base towards the interior of the pump, between the inside surface 35 of the wall and the pump tube 50 which is mounted sealingly thereby; the latter does not contact the pump housing 12 at the clamping location, around the latter, as is confirmed by the spacing identified by reference 64*a* at the opposite side of the tube in FIG. 1, and the inside diameter k of the wall connection 36; it is larger than the outside diameter e of the tube. The above-mentioned through openings 47 in the slide shoe 48 and apertures 44 in the rotor end portion 13 as return flow openings promote the coolant flow.

The wall 36 of the pump housing 12, towards the edge, becomes an external flange 37 which is formed thereon and on which fits, with the interposition of a sealing ring 65, a pump cover 66 which is screwed thereto. An outlet connection 68 of small diameter is formed on the pump cover 66 and can be closed by a closure screw 69 with sealing ring 70. Disposed adjacent the end of the pump cover 66, which is the upper end in FIG. 2, is a further bush configuration 72 which extends parallel to the axis of the pump and which is of a larger diameter than the outlet connection 68. The bush configuration 72 projects laterally of the path of movement of the rotor wall portion 15 and the slide shoe 48 and is provided axially with a sight glass 73 and radially with a branch portion 74 as a filling element.

I claim:

1. A peristaltic pump comprising: a pump housing having a bottom thereof and a pump wall; a rotor in the pump housing having a rotor wall; a shaft for the rotor wherein the rotor is rotatable around the shaft; a pump tube with an elastically deformable wall, which pump tube is arranged in the pump housing at the bottom thereof and is fitted into the pump housing with a portion which is curved in a part-circular configuration around the shaft of the rotor within the pump wall and at a radial spacing relative thereto; wherein the cross-section of the pump tube is partially varied during the conveying operation by at least one component of the rotor which presses the pump tube in respect of cross-section against a support means; and wherein the pump housing is dish-like and has in cross section a bottom with a bottom first portion which is formed approximately at a right angle on the pump wall and a bottom second portion which is inclined from the bottom first portion towards the rotor at an angle of inclination (w), and wherein said portions define a channel space in the pump housing in which the rotor wall engages.

2. A pump according to claim 1 wherein the rotor is dish-like and includes a rotor end portion which is situated opposite to the pump housing and wherein the rotor wall and the pump wall are directed towards the bottom of the pump housing, wherein the shaft of the rotor is fitted directly to the rotor end portion.

3. A pump according to claim 2 wherein the rotor end portion and the shaft of the rotor are integrally formed.

4. A pump according to claim 2 wherein the rotor end portion is provided with at least one opening for coolant or lubricant.

5. A pump according to claim 4 including a slide shoe in said pump housing with a radially outwardly directed slide surface which projects towards the pump tube from the rotor wall, wherein said at least one opening in the rotor end portion is adjacent the slide shoe.

6. A pump according to claim 5 wherein associated with the opening in the rotor end portion is at least one conveyor vane which projects from the rotor end portion.

7. A pump according to claim 6 wherein the conveyor vane extends from the slide shoe on both sides thereof along the side edge of the opening in the rotor end portion.

8. A pump according to claim 1 including radial spacing (i) of the pump wall of the pump housing from the rotor wall, wherein the rotor wall is rotatable within the channel space and wherein the radial spacing is equal to or smaller than the outside diameter (e) of the pump tube.

9. A pump according to claim 1 wherein the inclined bottom second portion of the pump housing is formed by means of an annular bottom third portion on a bearing neck which accommodates the shaft of the rotor.

10. A pump according to claim 9 wherein the bearing neck projects axially beyond the bottom third portion, including an annular rib of the bearing neck which accommodates at least one sealing element.

11. A pump according to claim 1 including a slide shoe in said pump housing with a radially outwardly directed slide surface which projects towards the pump tube from the rotor wall.

12. A pump according to claim 11 wherein the outwardly directed slide surface has sides, and wherein the distance (q) by which the slide surface projects decreases from a maximum towards the sides of the slide surface.

13. A pump according to claim 11 wherein the slide surface in plan view affords substantially the contour of half an oval which is cut on its long axis.

14. A pump according to claim 11 wherein the slide shoe is provided with through openings for lubricant and coolant between the slide surface and the rotor.

15. A pump according to claim 14 wherein the slide surface is provided along a wall of the slide shoe and defines the through openings in the slide shoe.

16. A pump according to claim 11 including a pair of slide shoes on a common diameter of the rotor.

* * * * *